United States Patent [19]

Hadley et al.

[11] 3,969,256

[45] July 13, 1976

[54] SOAP SAVER

[76] Inventors: Harry A. Hadley, c/o George Spector, 3615 Woolworth Building, 233 Broadway; George Spector, 3615 Woolworth Building, 233 Broadway, both of New York, N.Y. 10007

[22] Filed: Jan. 15, 1974

[21] Appl. No.: 433,515

[52] U.S. Cl. ..... 252/92; 252/134; 252/174; 252/DIG. 16

[51] Int. Cl.[2] ..... C11D 17/02; C11D 17/04

[58] Field of Search ..... 252/134, 174, DIG. 16, 252/90, 91, 92, 93; 15/104.93; D73/1 A

[56] References Cited

UNITED STATES PATENTS

| | | | |
|---|---|---|---|
| 235,730 | 12/1880 | Borie | 252/134 |
| 821,245 | 8/1905 | Hutchinson | 252/92 |
| 1,686,864 | 10/1928 | Kingman | 252/91 X |
| 1,723,560 | 8/1929 | Kurodn | 252/91 |
| 1,997,474 | 4/1935 | Stone | 87/23 |
| 3,359,206 | 5/1964 | Cratsa | 252/92 |
| 3,403,106 | 9/1968 | Story | 252/92 |
| 3,413,230 | 11/1968 | Dupuis | 252/92 |

FOREIGN PATENTS OR APPLICATIONS

| | | | |
|---|---|---|---|
| 835,913 | 3/1970 | Canada | 252/91 |
| 1,956,993 | 11/1969 | Germany | 252/92 |

*Primary Examiner*—Samuel W. Engle
*Assistant Examiner*—Ralph Palo

[57] ABSTRACT

An improved bar of soap which includes a central plastic core in order to prevent the inevitable disintegration of the last remaining portion of the bar when it gets small; the bar being manufactured by the soap material being molded all around the core.

1 Claim, 5 Drawing Figures

SOAP SAVER

This invention relates generally to bars of soap.

It is generally well known that after a long use, a conventional bar of soap gets smaller and very thin so that in use during lathering operation, it tends to break up into fragments and in the end must be picked out of a drain which is an undesirable nuisance. This situation is of course objectionable and is therefore in want of an improvement.

Accordingly, it is a principal object of the present invention to provide an improved bar of soap which eliminates the above described situation by including a central strengthening core so that the soap cannot be broken when it gets thinner.

Another object is to provide an improved soap bar which accordingly saves on wasted, broken up soap, and which if manufactured with the core being hollow, will thus cause the soap bar to float in water so that it can be readily retrieved.

Still another object is to provide a soap saver which accordingly saves on soap material by not being used at the bar center.

Other objects are to provide a soap saver which is simple in design, inexpensive to manufacture, rugged in construction, easy to use and efficient in operation.

These and other objects will be readily evident upon a study of the following specifications and the accompanying drawings wherein.

Figure 2:
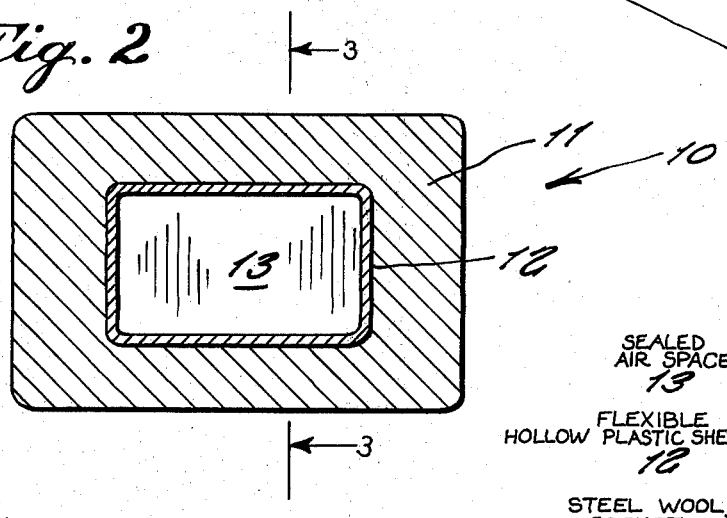
FIG. 2 is a cross sectional view on line 2—2 of FIG. 1.
Figure 3:
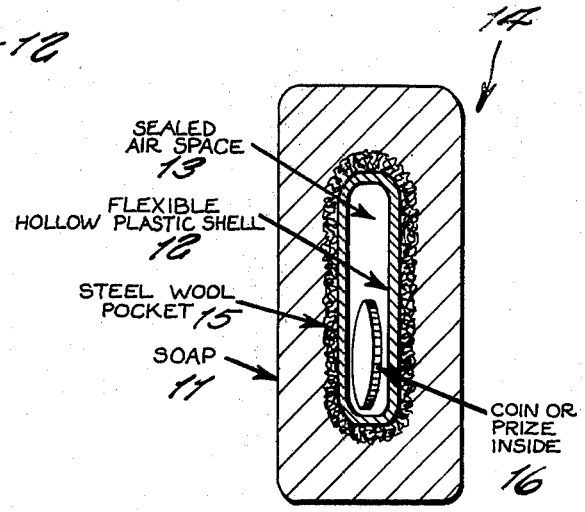

FIG. 3 is a cross sectional view on line 3—3 of FIG. 2, and showing a modified design of the invention in which the central shell is flexiable so to form a core of a steel wool pad around it so that after the soap bar is worn down a bit it can be used for scrubbing pots and pans; and after the steel wool pad is worn, the pad can be broken open so to remove a prize or a coin gift used as a premium by a manufacturer.

Figure 4:
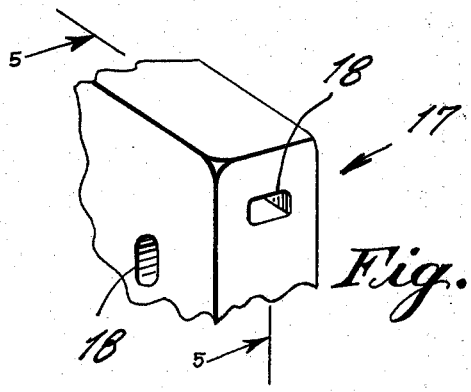

FIG. 4 is a detail of another modified design in which crossing channels through the bar soap portion provide greater surface for lathering so the same is quicker and easier to accomplish.

Figure 5:
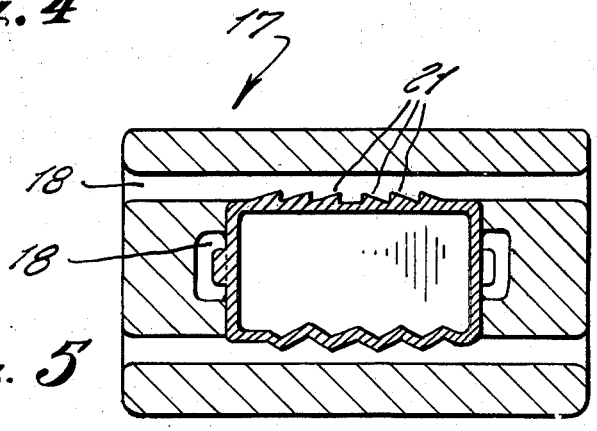

FIG. 5 is a cross section on line 5—5 of FIG. 4 and showing the outer surface of the central core to be toothed or ridged and which forms a side of the grooves so to turbulate the water moving through the channel, thus increase the lathering action.

Figure 1:
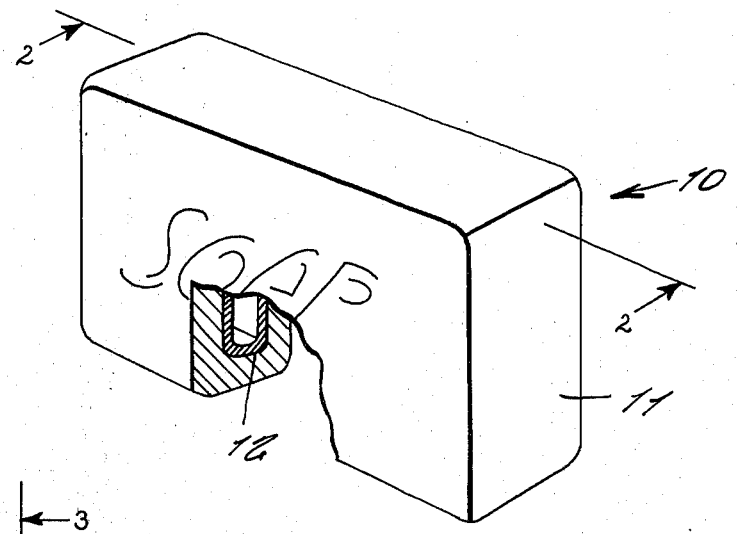
FIG. 1 is a perspective view of the invention shown partly in cross section so to illustrate the interior structure.

Referring now to the drawing in detail, and more particularly to FIGS. 1 and 2 at this time, the reference numeral 10 represents a soap saver according to the present invention wherein there is a bar 11 made of soap material that is molded around a central core 12 made of molded plastic and which comprises a thin shell around a sealed, hollow, central space 13.

In operative use, it is now evident that as the soap bar wears thin, the core provides rigidity so to prevent the soap bar from breaking in half or breaking up. Also in use, the bar of soap being hollow at its center, will float in water.

Thus an improved bar of soap is provided.

In FIG. 3, a modified design of soap saver 14 incorporates all of the above described features, and additionally there is steel wool pad 15 found with a central pocket so to fit around the outer side of the core and soap material 11 which impregnates the pad 15. In this form of the invention, the core may be made of a semi-soft plastic material so that as the soap bar material 11 wears thinner the soap inpregnated pad 15 can be used for scouring out pots and pans. After even its device as a scouring pad ceases, the core still serves a worthwhile purpose, as it can then be cut open so that a user can extract a prize 16 from the interior thereof, such as a coin (as shown) or other worthwhile premium which would be a promotional sales feature so that consumers will buy this soap instead that of another competitor manufacturer.

In FIGS. 4 and 5 another design of soap saver 17 in which cross channels 18 through the soap bar 11 allow water to surge therethrough during lathering, so a large quantity of lather is quickly produced.

In FIG. 5, the plastic core 19 additionally has an outer surface 20 engaged by channels 18; the outer surface 20 having irregular sloped teeth 21 so to increase the turbulence of water that surges through the channels so that the water thus still more quickly gets lathered up as it washes against the other surface of the channels that are made of the soap material 11.

Thus different forms of the invention are presented.

While various changes may be made in the detail construction, it is understood that such changes will be within the spirit and scope of the present invention as is defined by the appended claims.

What is claimed is:

1. A bar of soap comprising a hollow plastic shell in combination with soap material molded about said shell, including a jagged surface on the surface of said shell wherein the jagged surface is formed by irregular shaped teeth on the shell surface, further including longitudinal and transverse channels which intersect, wherein some of said channels communicate with the jagged surface and the outer surface of the bar of soap thereby generating turbulance for improved lathering purposes.

* * * * *